US005137270A

United States Patent [19]

Sloan et al.

[11] Patent Number: 5,137,270

[45] Date of Patent: Aug. 11, 1992

[54] CUSTOMER INSTALLABLE BYPASS SHEET TRANSPORT WITH COVER ASSEMBLY AND LOCATING SPRINGS

[75] Inventors: James L. Sloan, Avon; Patrick T. Pendell, Rochester, both of N.Y.

[73] Assignee: Xerox Corporation, Stamford, Conn.

[21] Appl. No.: 607,404

[22] Filed: Oct. 31, 1990

[51] Int. Cl.[5] ..... B65H 5/06

[52] U.S. Cl. ..... 271/272; 271/273

[58] Field of Search ..... 271/272-274, 271/256, 289, 290, 306, 198, 314; 270/53, 58

[56] References Cited

U.S. PATENT DOCUMENTS

| | | | |
|---|---|---|---|
| 3,076,647 | 2/1963 | Lowe et al. | 270/58 |
| 3,709,492 | 1/1973 | Baker et al. | 271/290 |
| 3,743,406 | 7/1973 | Komori et al. | 355/8 |
| 3,848,867 | 11/1974 | Johnson | 271/173 |
| 3,853,314 | 12/1974 | Anderson | 271/173 |
| 4,352,490 | 10/1982 | Hatakeyama | 271/289 |
| 4,353,543 | 10/1982 | Ikeda et al. | 271/306 |
| 4,482,148 | 11/1984 | Stewart, Jr. | 271/273 |
| 4,515,458 | 5/1985 | Masuda et al. | 355/3 SH |
| 4,711,444 | 12/1987 | Geurts | 271/290 |
| 4,835,567 | 5/1989 | Ogata | 271/164 X |
| 4,958,823 | 9/1990 | Iwaki et al. | 271/164 X |

FOREIGN PATENT DOCUMENTS

| | | | |
|---|---|---|---|
| 3718131 | 12/1988 | Fed. Rep. of Germany | 271/306 |

*Primary Examiner*—David H. Bollinger

*Attorney, Agent, or Firm*—William A. Henry, II

[57] ABSTRACT

A modular customer installable bypass paper transport that allows printed output from a printer to bypass an output tray of the printer and pass directly into a separate finisher includes a cover assembly and two locating springs that are essential for proper location of idler which are part of the cover and drive rollers during re-engagement of the idler and drive rollers after a jam has been cleared. The two wire form springs are attached to the cover and a cover support member and are stressed from a home position when the cover is slid to a remote position for jam clearing. As the cover is slid back to its home position, the springs pull the cover and idler rollers into proper alignment with mating drive rollers.

12 Claims, 9 Drawing Sheets

CUSTOMER INSTALLABLE BYPASS SHEET TRANSPORT WITH COVER ASSEMBLY AND LOCATING SPRINGS

Reference is hereby made to the following copending applications with common assignee including U.S. Application Ser. No. 07/608,052, filed Oct. 31, 1990, now U.S. Pat. No. 5,101,240, entitled System for Aligning a Printer with a Finisher by Patrick T. Pendell et al. and U.S. Application Ser. No. 07/608,053, filed Oct. 31, 1990, now U.S. Pat. No. 5,080,348, entitled Customer Installable Bypass Sheet Transport for Connecting a Printer to a Finisher by Patrick T. Pendell et al., both of which are incorporated herein by reference.

This invention is directed to copiers/printers/duplicators, and more particularly, to a means for properly locating a cover assembly and thereby ensure alignment of drive and idler rollers of bypass transports of such copiers/printers/duplicators. The primary product of printing businesses, and the like, is customer pertinent information printed on paper. This product takes many forms: from stacks of loose sheet print to stuffed, sealed and metered envelopes. Some products do not have the capability to prepare a full range of output products, and therefore, do not meet all of needs of the customer. As designed, these machines can deliver stacked output and stitched output. Those users of such equipment, but requiring other forms of output, must take these two forms of output to other locations for further finishing operations. This is perceived by some as a limitation on such equipment, and this limitation generates an expense of manually transporting output from one operation site to another.

In view of the aforegoing, there is a need to accommodate printers, or the like, with output devices that will increase capability and utility of the printers.

In the past, various output devices have been designed for connection to printers, or the like, e.g., a copying machine having a sorter connected to it is disclosed in U.S. Pat. No. 4,515,458. The copying machine can be operated in a book mode or sheet mode and the sorter can be selected to operate in a collator or sorter mode by a control unit. Copy papers ejected from the copying machine are passed through a bridge mechanism to the sorter.

U.S. Pat. No. 3,853,314 discloses a collating apparatus for use in association with copying machines having a plurality of sheet receiving trays. The sheets are conveyed by means of a distribution mechanism which includes belts and supporting pulleys.

U.S. Pat. No. 4,711,444 is directed to a sorting device for use with copying machines. The device comprises a plurality of superposed sheet receiving bins, a first conveyor for selectively feeding conveyed sheets to the receiving bins, and a second conveyor for conveying sheets from a copier to the first conveyor. The second conveyor includes an operative and an inoperative position.

In U.S. Pat. No. 3,076,647, a collating machine is disclosed integrated in a cooperative relationship with a printing machine. Separate stacking and handling of printed sheets at the printing machine are eliminated as the collating machine receives each sheet as it is printed through a conveyor belt.

U.S. Pat. No. 3,848,867 discloses a sheet distributor which receives paper from a printer and distributes the printed sheets to various stations. The sheets are delivered to the sheet distribution apparatus by a sheet conveyor.

An electrophotographic copying apparatus is shown in U.S. Pat. No. 3,743,406 that includes a machine housing located in an upper portion of the apparatus which includes a means for transporting paper. The apparatus includes springs which are compressed to keep a lid closed when an upper roller group supporting unit is in a closed position. When the lid is closed, a hook extends downward from the lid and engages a dowel located at an upper end of a lever arm. Additional springs are provided at the opposite ends of bearing plates so that an upper roller group is parallel to a lower roller group.

A paper handling apparatus is disclosed in U.S. Pat. No. 4,482,148 that includes a gate assembly which loads and feeds paper. In a loading position, a paper is placed between a carrier assembly over drive rollers and is guided to the next position. At a feeding position, pressure rollers are in parallel position with the driver rollers which frictionally feed the paper. Springs create a friction gripping pressure to engage the paper and hold the gate in its two positions.

All of the aforementioned references are incorporated herein by reference.

These devices, while serving as output devices for printers, or the like, do not answer the need for a simple, low-cost means for aligning drive and idler rollers after the two have been separated for jam clearing purposes.

Accordingly, a cover for an electrophotographic machine is disclosed that includes a baffle assembly connected to the cover and idler rollers mounted within the baffle assembly. The improvement for aligning the idler roller with mating drive rollers positioned for engagement with the idler rollers in order to form a copy sheet path therebetween includes a support member for supporting the cover and dual wire form springs for positioning the idler rollers in proper alignment the said drive rollers. The dual springs are connected to the cover and the support member and have a first portion thereof extending in a horizontal plane and a second portion thereof extending in a vertical plane so that when the baffle assembly is slid in a horizontal plane away from a home position to a remote location in order to remove jammed copy sheets, the springs are stressed, and when the jammed copy sheets have been removed and the baffle assembly is slid toward the home position the springs pull the baffle assembly and thereby the idler rollers into proper alignment with the drive rollers.

Other features of the present invention will become apparent as the following description proceeds and upon reference to the drawings, in which.

While the present invention will hereinafter be described in connection with a preferred embodiment thereof, it will be understood that this is not intended to limit the invention to that embodiment. On the contrary, it is intended to cover all alternatives, modifications and equivalents as may be included within the spirit and scope of the invention as defined by the appended claims.

Figure 1A:
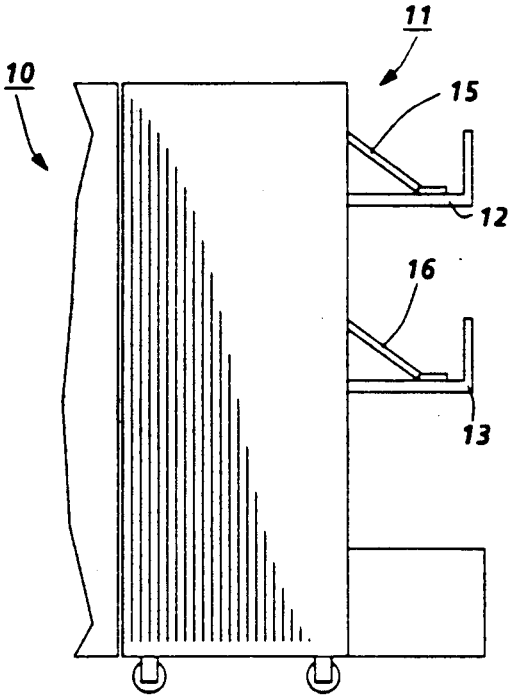
FIGS. 1A–1C show a schematic elevational view of a conventional printer that includes a conventional output device with a bypass transport including the cover alignment apparatus of the present invention installed in an output tray of the output device.
Figure 1B:
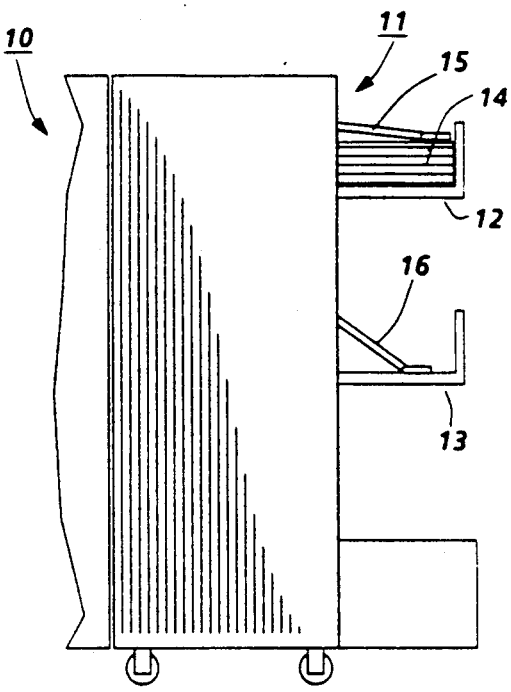
Figure 1C:
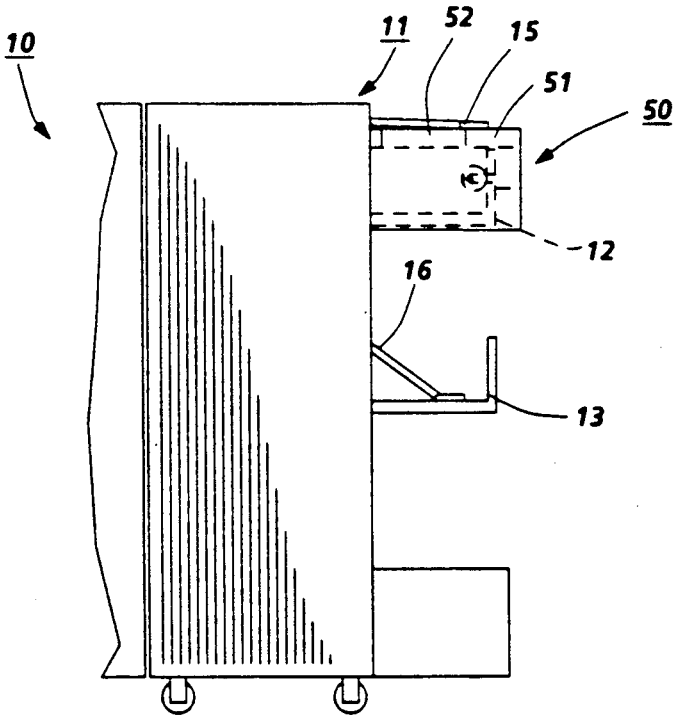
Figure 6:
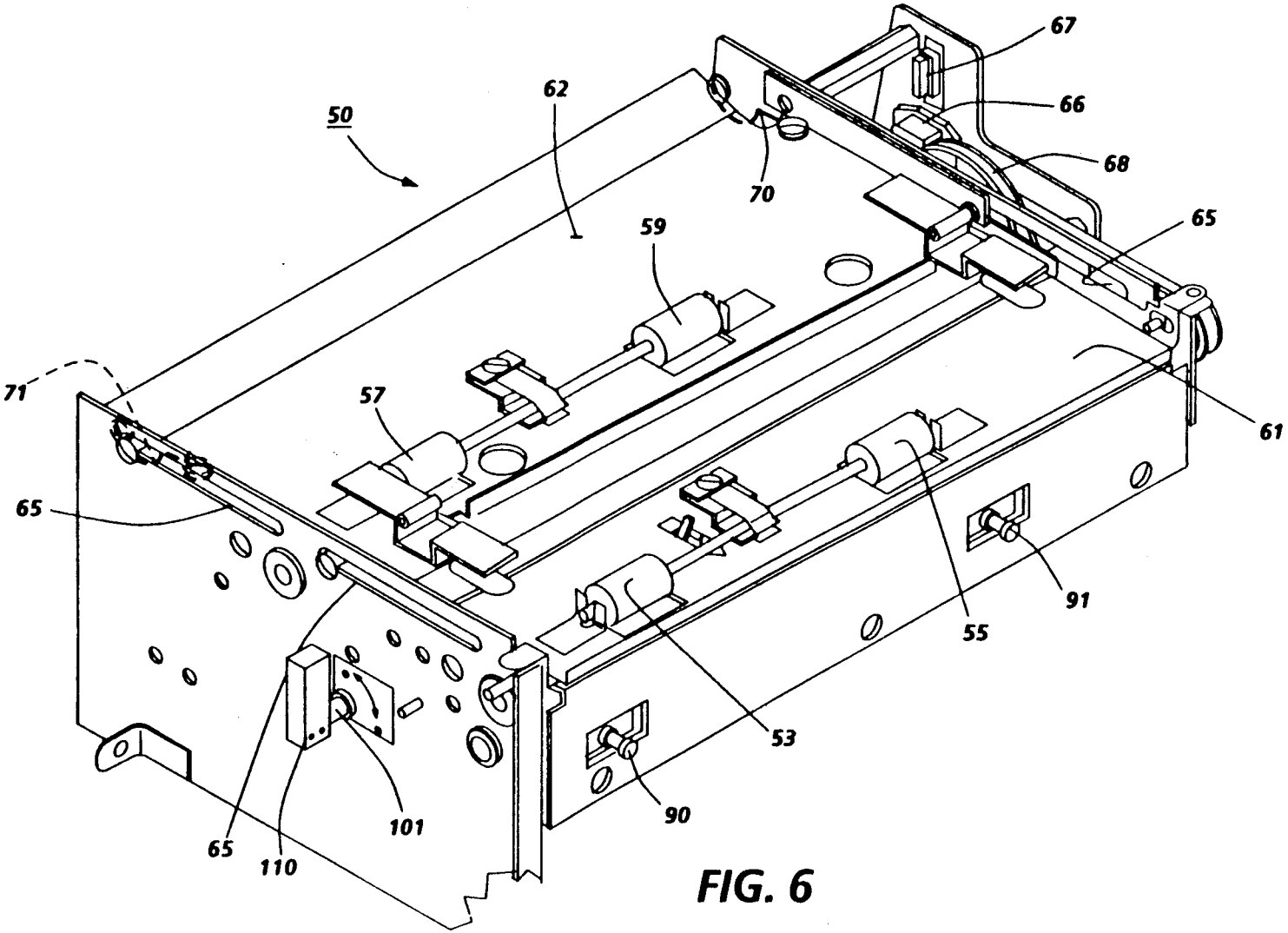
FIG. 6 is a partial isometric view of the bypass transport of FIG. 1 with its covers removed.

For a general understanding of the features of the present invention, reference is made to the drawings. In the drawings, like reference numerals have been used throughout to designate identical elements where FIG. 1A schematically depicts a conventional two-bin stacker 11 connected to a conventional printer 10, such as, the Xerox 4090®. In FIG. 1B, the stacker 11 is shown with copy sheets 14 filling bin 12 and held in place by normal force member 15. The copy sheets have been removed from bin 12 in FIG. 1C and replaced by a bypass transport 50 in accordance with the present invention. Bypass transport 50 weights about 30 lbs and is lifted to the height of the tray and pushed in toward the rear of stacker 11. The distance it can be pushed is limited by a feature on its cover. Inside the front cover, as shown in FIG. 6, there is a handle 110 which, when turned, locates the transport properly from left to right. The transport receives power from the two-bin stacker through a power cord which extends from the back of stacker 11 to the back of the transport. The transport also receives signals through a similar cable located the same way. These two cables are plugged in by the user during installation. At this point, the bypass transport is ready to deliver printed output to third party finishing equipment.

Figure 2:
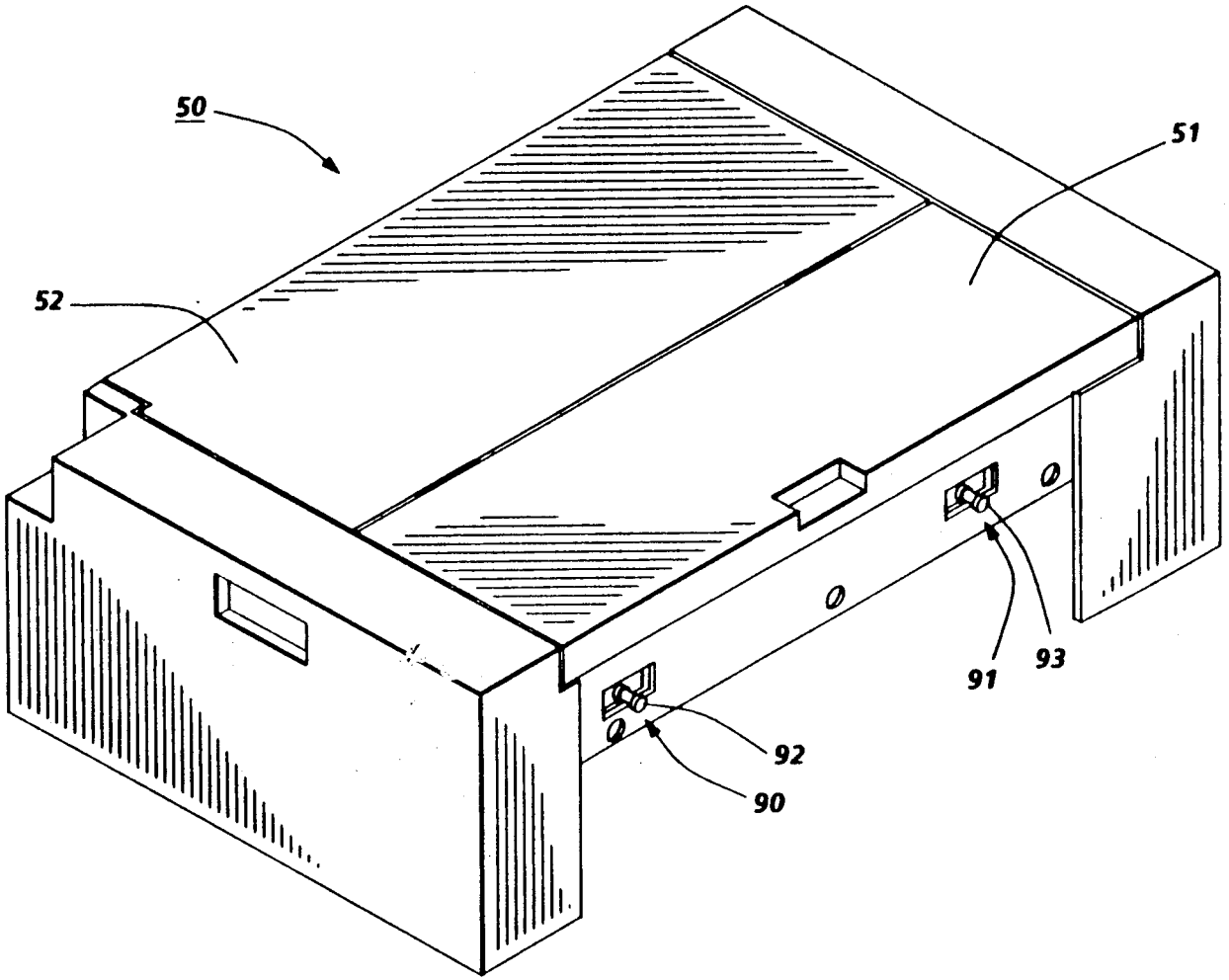
FIG. 2 is an isometrical schematic of the bypass device of FIG. 1 showing alignment switches.

Alignment of third party equipment with bypass transport 50 is essential if smooth flow of copy sheets from the bypass transport to the third party equipment is to be accomplished. It is not desirable to physically mount the unknown mass of third party equipment to the 30 lb transport because the certain weight mismatch will cause significant damage if some outside force tries to move the third party equipment out of alignment. Also, it would not be desirable to mount the third party equipment to the base frame of the host printer 10 because unknown third party equipment vibrations could be transmitted to the base machine and potentially, could effect copy quality. For these reasons, bypass transport 50 is shown in FIG. 2 with switches 91 and 92 mounted on its right hand end having plunger type actuators 93 and 94. This type of connection system allows minimum contact between modules while simultaneously enhancing alignment between the modules. The third party equipment is required to have similarly located parts on its left hand end in order to compress the plungers as the third party equipment approaches the bypass transport. Compressing the plungers changes the state of the switches, e.g., opened to closed, closed to opened. The firmware or logic of the host printer will monitor the state of the switches, such that it knows if one of them is not compressed when it should be. The switches are wired such that, if only one of them is not compressed, the logic signal being monitored changes levels.

Figure 3:
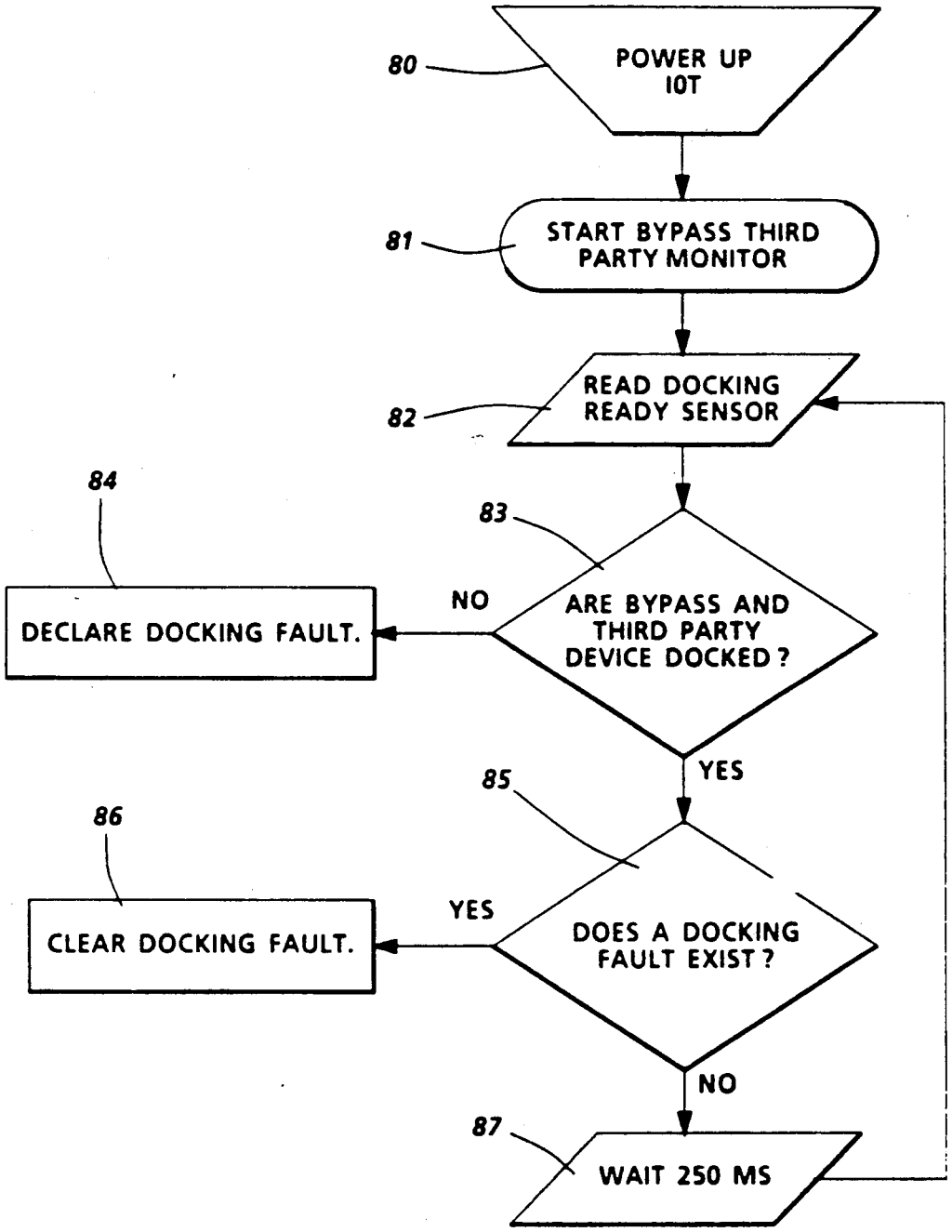
FIG. 3 is a Logic Flow Diagram that controls alignment of the bypass transport with third party finishers.

The logic flow diagram in FIG. 3 shows the operation of the bypass transport 50 in which the host printer 10 is powered up in block 80 and monitoring of the bypass transport and third party equipment is initiated in block 81, while the read docking and ready sensor is initialized in block 82. If the bypass transport and third party equipment are not docked as monitored in decision block 83, a fault is declared in block 84. But, if the docking of the bypass transport and the third party equipment is indicated, a decision in block 85 is made as to whether a docking fault exists. If a docking fault does exist, it is indicated in block 86 and cleared. When no docking fault exists, decision block 85 sends a signal to block 87 where a wait of 250 ms expires before a signal is sent to the ready sensor in block 82. The bypass transport is now properly connecting output from printer 10 to the third party equipment.

Figure 4A:
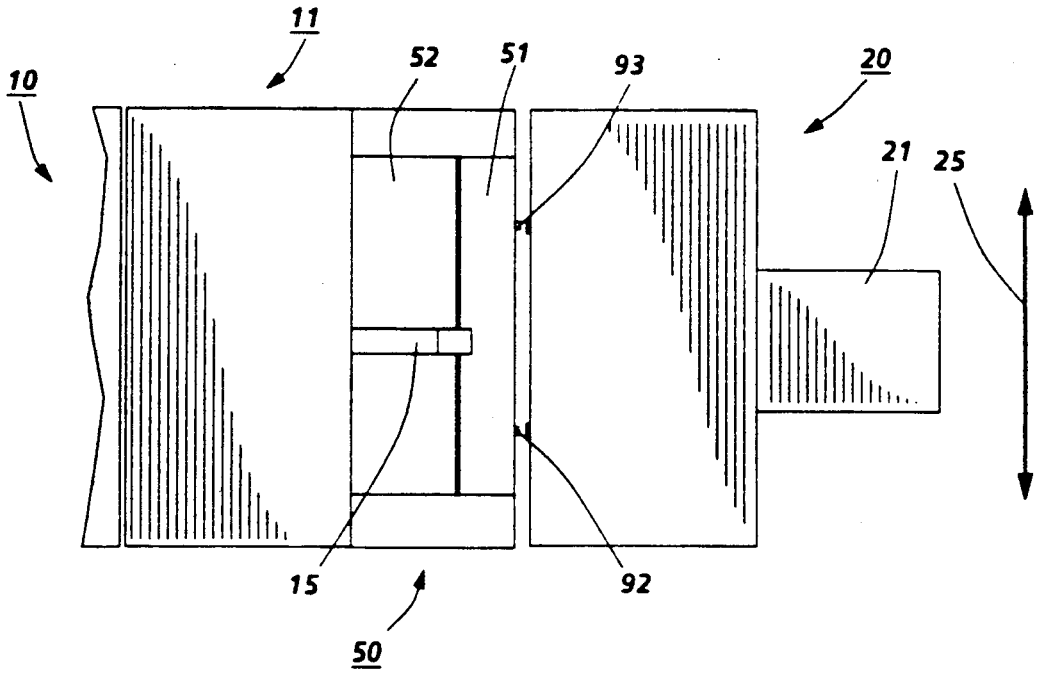
FIGS. 4A and 4B show partial schematical top and side views of the bypass transport of FIG. 1C mounted in an output tray of a printer apparatus, or the like, and the types of alignment of third party equipment that is controlled.
Figure 4B:
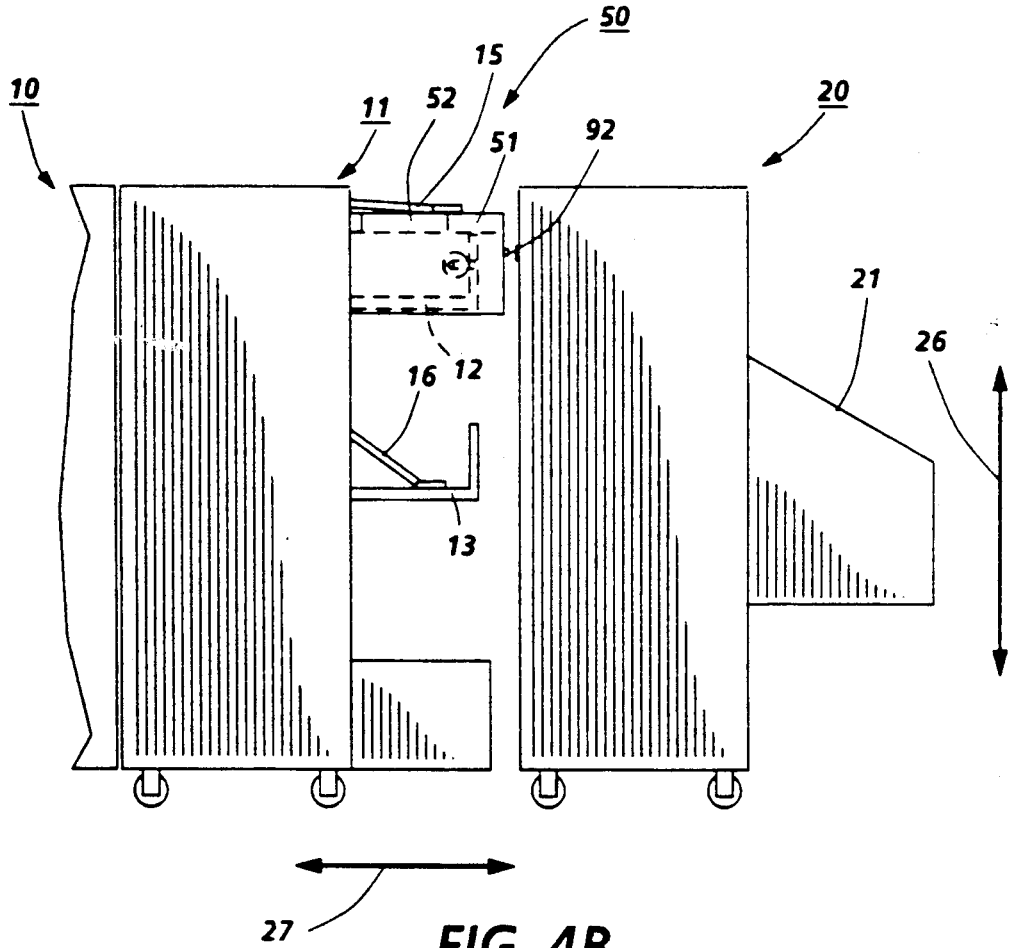

Switches 90 and 91 are wired such that, if only one of them is not compressed, the logic of FIG. 3 being monitored changes levels. The detectable types of the misalignment are shown in FIGS. 4A and 4B in that any significant amount of misalignment from any of three planes will be detected by the sequence of the flow diagram in FIG. 3 and result in a machine shutdown. Shutdown is followed by a message displayed to the machine operator stating the nature of the fault, (e.g., Third Party Docking Fault). The fault may not be reset unless the switches are again compressed. In FIG. 4A, a top view of stacker 11, bypass transport 50 and third party finisher 20 with output bin 21 is shown with arrow 25 indicating detectable side-to-side misalignment. Misalignment in a vertical, as well as, horizontal plane i detectable in FIG. 4B as indicated by directiona' .ow 26 and 27, respectively.

Figure 5A:
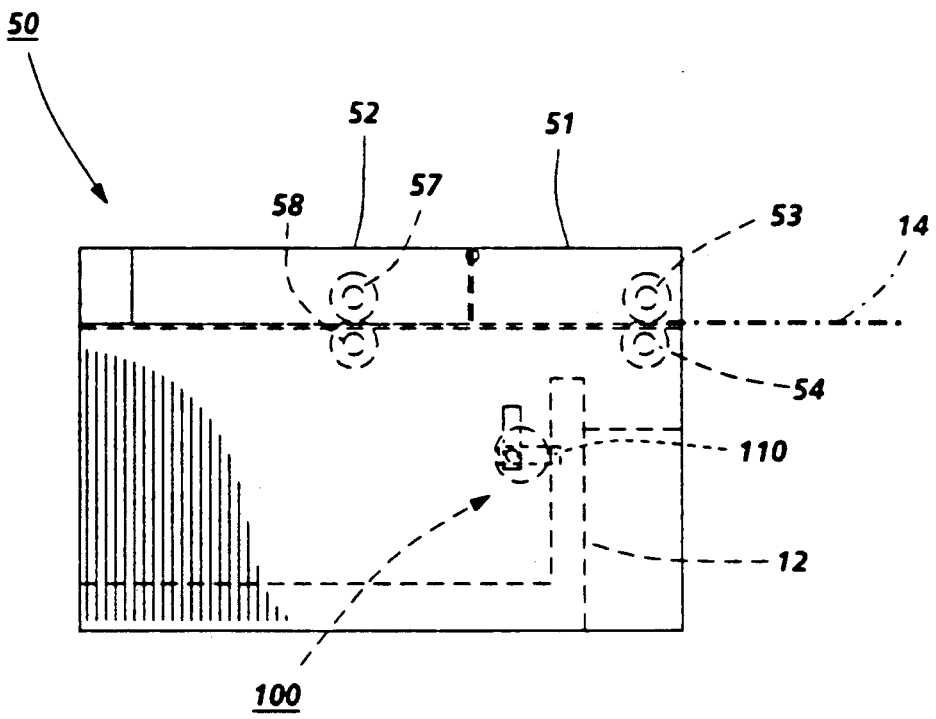
FIGS. 5A and 5B are schematic partial side views of the bypass transport of FIG. 1C showing in accordance with the present invention its cover in a closed, as well as, open position.
Figure 5B:
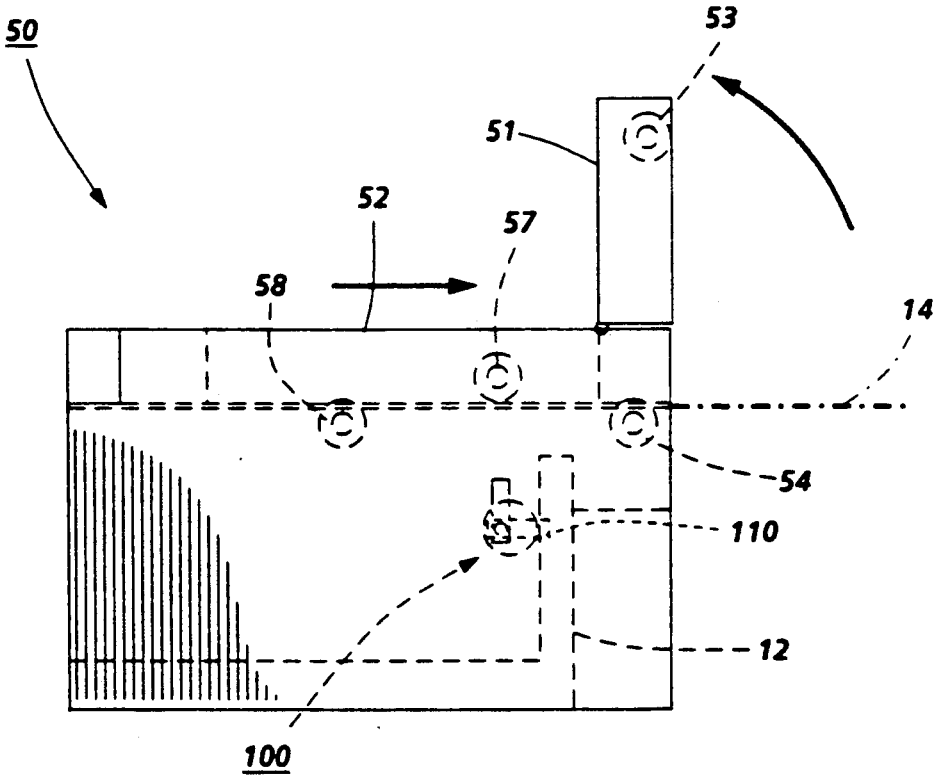
Figure 7:
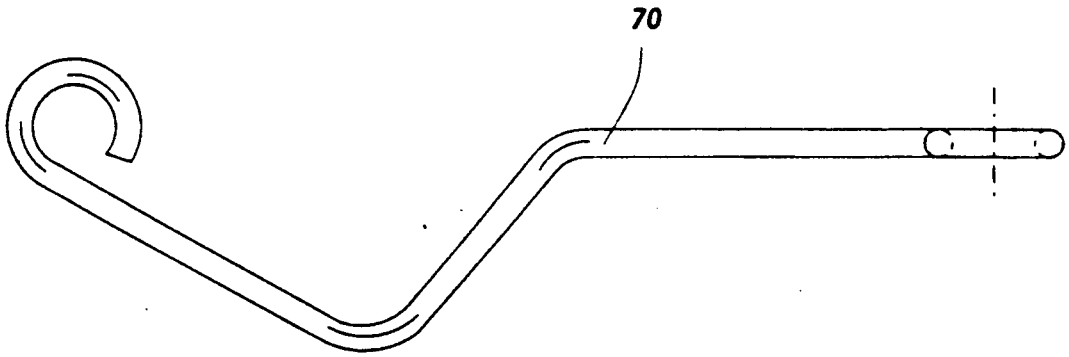
FIG. 7 is a side view of one of two spring steel wires used to properly position idler rolls with mating drive rolls in the bypass transport.

During jam clearance procedure in accordance with the present invention for bypass transport 50 in the unlikely event of a paper jam, the alignment of roller pairs (53,54), (55,56), (57,58) and (59,60) in FIGS. 5A, 5B and 6 is upset. To clear a jam, top cover portion 51 is opened and with cover portion 52 are slid to the right in FIG. 5B. This motion separates the roller pairs, therefore, a means is necessary to positively restore roller alignment when cover portion 51 is closed and both cover portions 51 and 52 are slid to the left to resume their position in FIG. 5A in order to prevent further jams where misaligned rollers would cause copy sheets to feed downward and jam or wrinkle as opposed to feeding horizontally as designed. This potential problem is answered by two spring steel wire form springs 70 and 71 in FIG. 7 attached to cover baffle assembly 62. The springs extend into a notch in the bottom baffle beneath baffle assembly 62. The springs extend into a notch in the bottom baffle 62 beneath them. When the covers 51 and 52 are being slid toward their home position after having been slid to the right and cover 51 opened in FIG. 5B, the springs are in a stressed state. As the springs begin to enter the notch at the home position they actually pull the cover assemblies into position.

The positioning of the springs and notches during assembly allows the roller pairs to be properly aligned. Cover assemblies 51 and 52 are prevented from traveling beyond the proper alignment by the length of the slots 65 within which they slide.

Figure 9:
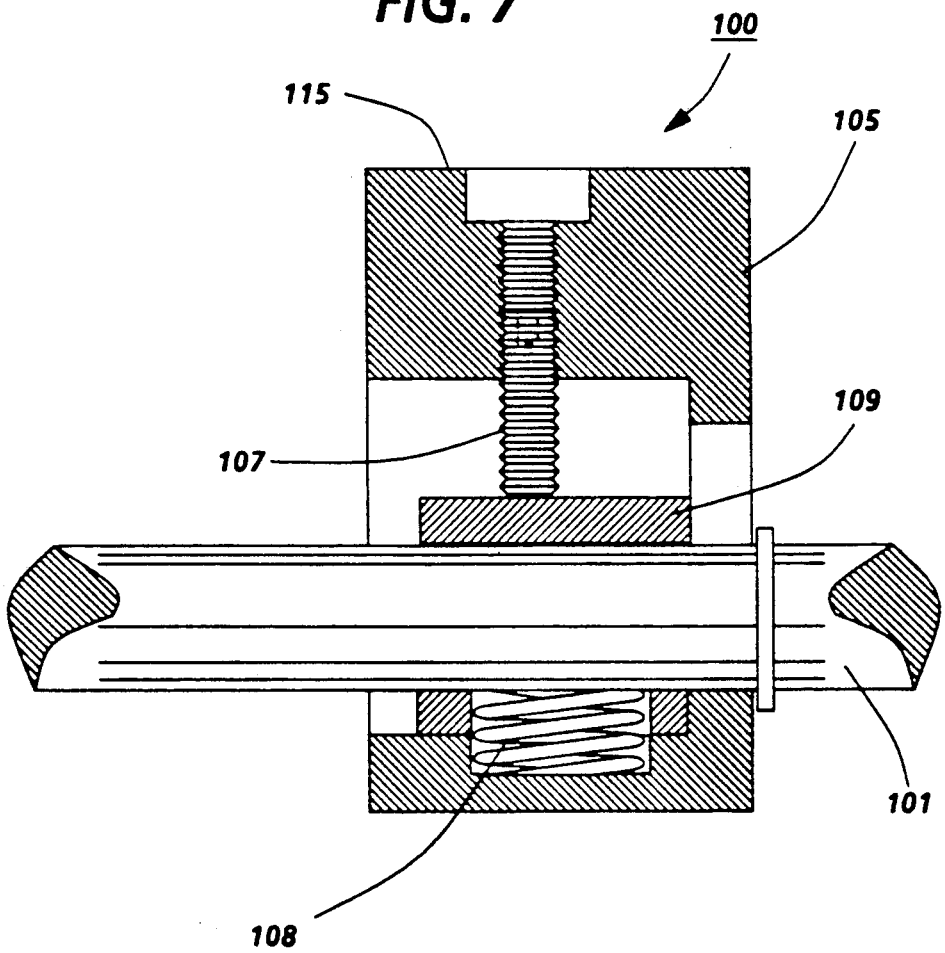
FIG. 9 is a partial, enlarged elevational view of a cam positioning device as shown in FIG. 8.
Figure 8:
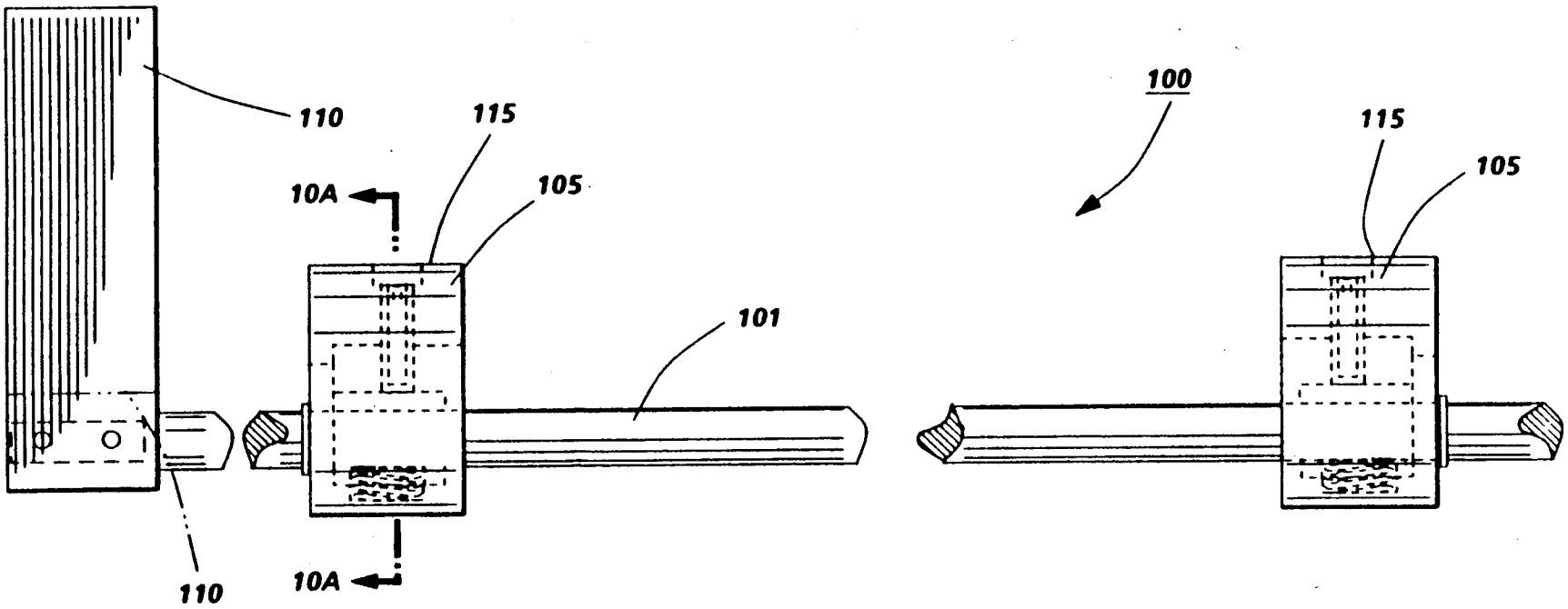
FIG. 8 is an elevational view of an adjustable cam positioning device used in the bypass transport of FIG. 2.
Figure 10A:
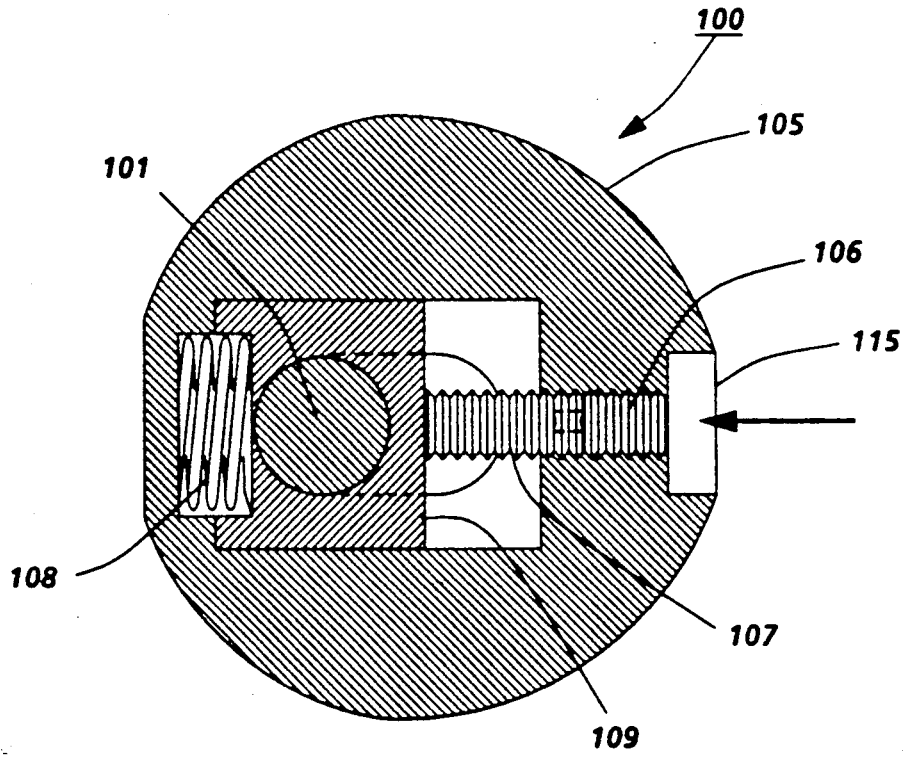
FIGS. 10A and 10B show an enlarged cross-section of a the cam positioning device of FIG. 8 in an adjusted position in FIG. 10A and in a standard position in FIG. 10B.

In order to compensate for manufacturing tolerances of the stacker and predicted manufacturing tolerances of the bypass transport, bypass transport 50 is designed so that its maximum size is smaller than the minimum output tray size. In most situations, this will result in some amount of space around the transport which will allow movement during operation. To avoid paper travel difficulties, this extra space has to be consumed in order to prevent movement of the transport assembly. The mechanism for accomplishing this an adjustable cam positioning device 100 shown in FIGS. 8-10. The adjustable cam positioning device comprises a shaft 101 with a pressed on block 109 which nominally is concentrically positioned through a cam 105. The cam has a slot therein to house the shaft. Shaft 101 may be moved to any eccentric location within limits of the slot by virtue of a screw 107 pushing on one side of block 109 and a compression spring 108 on the other. Both screw 107 and spring 108 are housed in cam 105. The amount of eccentricity is only limited by the size of the cam and length of the slot.

Figure 10B:
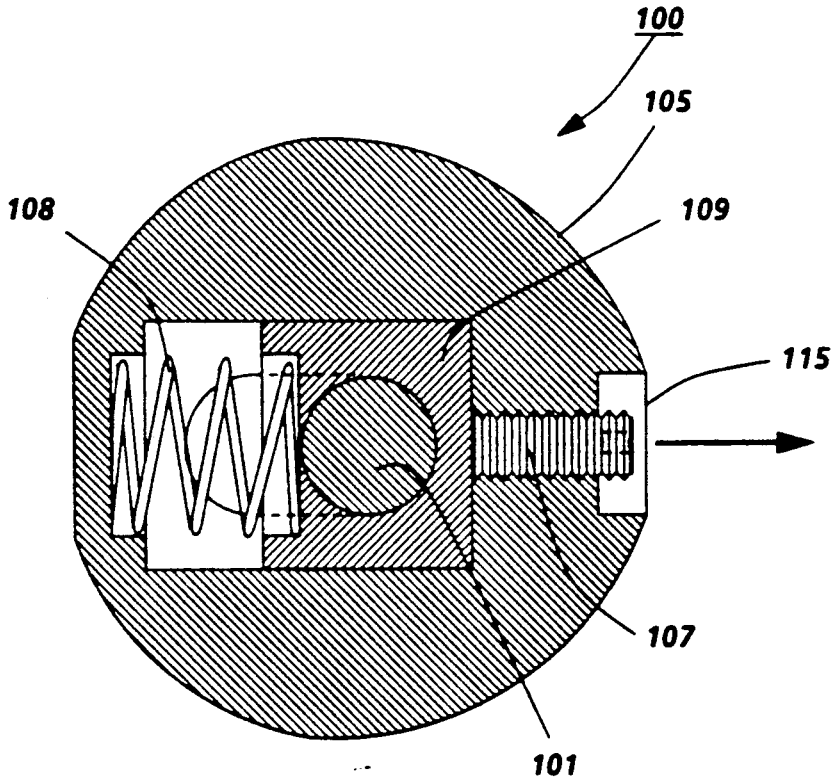

Normally, cam 100 is in the position shown in FIG. 10B when the bypass transport is placed in the bin of a stacker by a service technician. Handle 110 is then rotated to the right in order to estimate the amount of play between flat cam suface 115 and the inside surface of the end of the stacker bin. Handle 110 is then rotated to the left and screw 107 is turned within threads 106 with a screw driver by way of holes in lower baffle 62 in order to force flexible shaft 101 a small amount through block 109. Handle 110 is again turned to the right to see if the cam has been adjusted sufficiently to ensure a proper fit between flat cam surface 115 and the inside surface of the end of the stacker bin. This process is repeated until a satisfactory fit is obtained. Thereafter, all an operator has to do is lift the transport out of the bin and place it into a bin as desired since the tolerance has been adjusted previously.

It should now be apparent that an operator installable bypass sheet transport system is disclosed which can transport a printed output from one piece of finishing equipment to another piece of finishing equipment online and includes a cover alignment baffle assembly that enables opening of the cover having idler rollers connected thereto for removal of jammed copy sheets and closing the cover and idler rollers against drive rollers with proper alignment of the idler and drive rollers being maintained through the use of a set of wire form springs. The bypass transport is housed in a selected bin of a multi-bin finisher and receives power and control signals from the multi-bin finisher in order to deliver the printed output to a separate finisher. By way of example, bypass transport 50 is connected to stacker 11 by way of AC connector 66 and connector 67 and as mentioned hereinbefore, power comes into the transport through connector 67 and signals through connector 66. Copy sheets are driven through the transport by a conventional pulley system 68 through drive rollers 54, 56, 58 and 60 and out of an exit path beneath assembly baffles 61 and 62.

What is claimed is:

1. A cover baffle assembly for an electrophotographic machine which prevents misalignment of rollers during jam clearing procedures, comprising: a cover member; a first baffle integral with said cover member and positioned over a second baffle with said first and second baffles forming a predetermined path through which copy sheets are driven, said second baffle having notched areas in one end thereof, said first baffle being slidably mounted with respect to said second baffle; at least two sets of drive/idler roller pairs positioned within cut-outs portions of said first and second baffles and adapted to drive copy sheets through said predetermined path, and wherein said idler rollers of said at least two pairs are mounted to said first baffle and said drive rollers of said at least two roller pairs are mounted to said second baffle; and two wire form springs in an unstressed state attached to said first baffle having a first portion thereof extending into said notched areas in said second baffle, so that when said first baffle is slid away from said notched areas by an operator in order to remove jammed copy sheets said springs are stressed out of said notched areas and when the jammed copy sheets have been removed and said first baffle is slid toward said notched areas said springs enter said notched areas and pull said first baffle into proper alignment with said second baffle.

2. The cover baffle assembly of claim 1, including a first baffle support member having slot therein, and wherein said first baffle is mounted to slide within said slot so that said slot prevents said first baffle from traveling beyond proper alignment by the length thereof.

3. The cover baffle assembly of claim 2, wherein said first portion of said two wire form springs extends in a horizontal plane and a second portion thereof extends in a vertical plane.

4. The cover baffle assembly of claim 3, wherein said first portion of said two wire form springs is attached to said first baffle and said second portion of said two wire form springs is attached to said first baffle support member.

5. The cover baffle assembly of claim 1, wherein said first baffle is adapted for sliding within said predetermined path in order to allow removal of jammed copy sheets from said predetermined path.

6. The cover baffle assembly of claim 5, wherein said cover member and said first baffle are two-part members with one part of said two-part members being pivotable simultaneously from a closed position within a horizontal plane to an open position within a vertical plane when removal of jammed sheets is required.

7. In a cover for an electrophotographic machine that includes a baffle assembly connected to said cover and idler rollers mounted within said baffle assembly, the improvement for aligning the idler rollers with mating drive rollers positioned for engagement with the idler rollers in order to form a copy sheet path therebetween, comprising: support means for supporting said cover and spring means for positioning said idler rollers in proper alignment with said drive rollers, and wherein said spring means is connected to said baffle assembly and said support means and having a first portion thereof which is connected to said baffle assembly extending in a horizontal plane and a second portion thereof which is connected to said support means extending in a vertical plane.

8. The cover of claim 7, wherein said first portion of said spring means extends parallel with said cover and said second portion of said spring means extends parallel with said support means.

9. The cover of claim 7, wherein said cover and said baffle assembly comprise two-part members with one part of each of said two-part members being pivotable simultaneously from a closed position within a horizontal plane to an open position within a vertical plane.

10. An apparatus for facilitating the removal of jammed copy sheets from a copy sheet transport path of an imaging apparatus, comprising: two-part cover means for covering the transport path, said two-part cover means including a first part adapted to be pivoted into a vertical plane and a second part adapted for slidable movement within a horizontal plane after said first part has been lifted into said vertical plane by an operator of the imaging apparatus in order to expose the copy sheet transport path.

11. The apparatus of claim 10, wherein said cover means includes at least two sets of idler roller mounted within a baffle.

12. The apparatus of claim 11, including wire form spring means for maintaining said cover means in a predetermined position, said wire form spring means being adapted to assume a stressed state when said slidable movement of said cover means occurs and to assume an unstressed state and pull said cover means back to said predetermined position when said slidable movement is discontinued.

* * * * *